United States Patent [19]

Conn

[11] Patent Number: 4,894,962

[45] Date of Patent: Jan. 23, 1990

[54] ARCHED STRUCTURE COMPRISING PRE-MANUFACTURED COMPONENTS

[76] Inventor: C. R. Conn, Rte. 2, Box 169A, Colville, Wash. 99114

[21] Appl. No.: 346,521

[22] Filed: May 1, 1989

[51] Int. Cl.[4] ..... E04B 1/32

[52] U.S. Cl. ..... 52/86; 52/108

[58] Field of Search ..... 52/71, 86, 108, 83, 52/227

[56] References Cited

U.S. PATENT DOCUMENTS

| | | | |
|---|---|---|---|
| 2,378,515 | 6/1945 | Tidwell | 52/108 |
| 2,874,812 | 2/1956 | Clevett, Jr. | 52/86 X |
| 3,260,022 | 7/1966 | Guyer et al. | 52/86 |
| 3,314,200 | 4/1967 | Schuster | 52/108 |
| 3,940,892 | 3/1976 | Lindbergh | 52/86 |
| 3,968,604 | 7/1976 | Hills | 52/86 |

FOREIGN PATENT DOCUMENTS

| | | | |
|---|---|---|---|
| 871159 | 8/1961 | United Kingdom | 52/86 |

*Primary Examiner*—David A. Scherbel
*Assistant Examiner*—Anthony W. Williams
*Attorney, Agent, or Firm*—Robert W. Jenny

[57] ABSTRACT

The subject structure comprises at least one assembly of premanufactured components. Each component comprises at least one beam with a fixture attached at each end. The fixtures are box shaped, having tops, bottoms, ends and side faces. The fixtures are longer (from end to end) than they are high (top to bottom) or thick (face to face) and the faces are perpendicular to the length of the beam. The fixtures are generally symmetrical about a plane perpendicular to and bisecting the faces. Each fixture has a flange extending from one end and a groove in the other. The components are pivotally connected to form an assembly, the pivotal connections being pins inserted through holes to hold the flange of one fixture in the groove of the next, the pin locations being near the tops of the fixtures. The fixtures are frusto-triangular in plan view, the tops being the bases of the triangles. Cables are threaded endwise through the fixtures near their bottoms. When these cables are tensioned, the fixtures are pulled in close end-to-end contact and, because of their angled ends, the assembly is formed into an arch shaped structure. The structures may be used singly or in numbers, side by side, to provide a structure of the desired length. The ends of the fixtures are at angles to their tops, the angles being in a range from 70° to 90°. The 90° angles produce an arch of infinite range, i.e. a flat structure.

5 Claims, 3 Drawing Sheets

FIG. 6
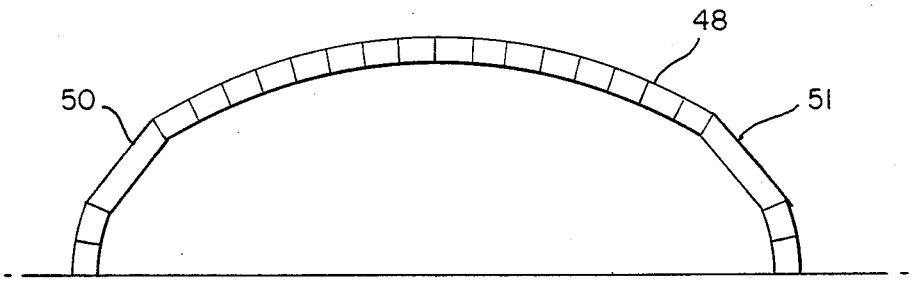
FIG. 7
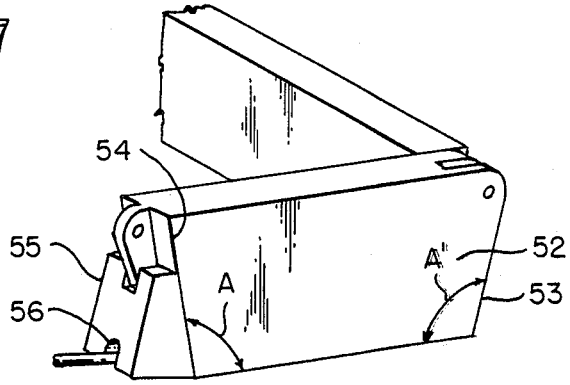
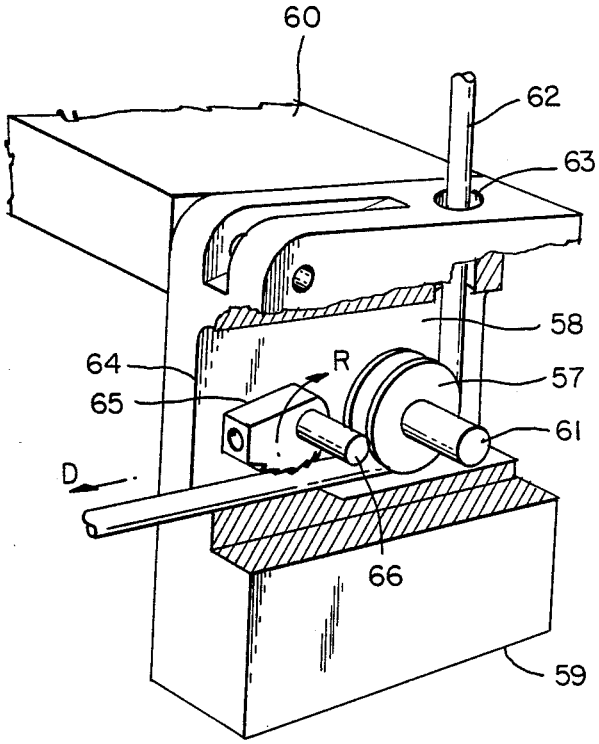
FIG. 8

ARCHED STRUCTURE COMPRISING PRE-MANUFACTURED COMPONENTS

BACKGROUND OF THE INVENTION

1. FIELD

The subject concept is in the field of structures for buildings, specifically building structures which incorporate arches as the basic structural component. More specifically, it is in the field of such structures which comprise pre-manufactured components and, further, can be readily erected or dismantled on site. Still more specifically, it is in the field of such structures primarily comprising a plurality of essentially identical pre-manufactured components.

2. PRIOR ART

There is much prior art relevant to the subject concept, some relating to erectable/dismantleable structure and some to more permanent structure incorporating structural techniques applicable in the field as described. The prior art includes the following U.S. Patents, listed in chronological order:

| | | |
|---|---|---|
| 604,708 | 2,793,720 | 3,897,622 |
| 1,093,127 | 2,985,264 | *3,940,892 |
| 2,104,356 | 3,057,119 | 3,968,604 |
| 2,360,285 | 3,084,909 | 4,071,985 |
| *2,574,241 | 3,343,319 | 4,204,372 |
| 2,693,195 | 3,559,353 | 4,325,207 |
| 2,704,522 | 3,786,484 | 4,353,190 |
| *2,733,482 | 3,849,953 | 4,373,305 |

The asterisked patents are considered to be the more relevant prior art in this case. All the prior art concepts have various relative advantages and disadvantages but certain characteristics found to be desirable in such structures, singly and/or in combinations, are not found in the prior art. It is notable that essentially all the prior art structures comprise arches having a constant radius. One desirable feature not found in the prior art is structure in the specific field adaptable to produce arches having a constant radius or a radius which varies to produce, for example, pseudo-elliptical arches. Pseudo-elliptical arches make possible buildings which cover a given floor area with less overall building height than needed for a building with constant radius arches. This results in savings in materials and in unused enclosed volume which may need to be heated or cooled, thus saving costs.

A second desirable feature, particularly in smaller buildings, is that the essentially identical components and the associated apparatus are such that a building made with them can have straight sidewall portions, vertical if desired.

A third desirable characteristic is that the structure be what is termed, for purposes of this disclosure, clean, i.e. free of external braces, cables, protrusions and the like which might interfere with use of the structure.

Accordingly, the objectives of the subject invention are to provide structures which are readily erected or dismantled, comprise primarily essentially identical components, are clean and are generally archlike with constant or variable radius arches, including straight portions, i.e. portions in which the radius is infinite.

SUMMARY OF THE INVENTION

The subject structure comprises primarily essentially identical components. In a preferred embodiment each component comprises a beam or girder having a fixture at each end. Each fixture is boxlike, frusto-triangular in planform and rectangular in the side and top views. The thickness of the fixture is a fraction of its width and height. For purposes of this disclosure the components have tops and bottoms, the longer dimension of the frusto-triangular shape being the top, and the fixtures are attached to the ends of the beams with the long dimension of the frusto-triangular shape at the top of the girder and perpendicular to the longitudinal axis of the girder. The fixtures on the beams in an assembly of the components are pivotally connected to each other, the pivoted connections being at the ends of the to surfaces of the fixtures. With the assembled components lying bottom down on a flat surface there are angles between the ends of the fixtures. When the bottoms of the fixtures are moved together to bring the ends of the fixtures into complete contact the assembly forms an arch. In the preferred embodiment the ends are brought into contact by a cable threaded through the fixtures end-to-end near the bottom surfaces. Tensioning the cable pivots the fixtures about their pivoted connections and brings the fixture ends into close contact with each other. Means are provided for providing the tension in the cables and for maintaining a desired tension once the component assembly is formed into an arch.

The radius of the arch or any portion of it is a function of the angles between the ends of the fixtures and their tops. The maximum angle is 90° since this would make the frusto-conical shape rectangular and the arch radius infinite, i.e. the assembly would be flat. As the angle is decreased, the arch radius also is decreased. With the angles in all the fixtures the same the arch radius is constant. Conversely, with the angles in some components different than in others, the radius of the arch will vary. In one preferred embodiment, equal pluralities of fixtures of the components at each end of an assembly of pin connected components have angles smaller than the angles of the fixtures of the components between the end pluralities. The result is that the erected arch is pseudo-elliptical in shape. If equal pluralities of components at each end of the assembly are fitted with fittings having rectangular platforms, the resulting arch will have flat portions and, with appropriate shaping of the end fixtures of the components between the end pluralities, the flat end portions will be vertically oriented.

In an alternate embodiment, the fixtures at the ends of the components are all identical and shaped to produce the smallest intended arch radius. Other radii are then obtained by modification of appropriate fixtures, one modification being the use of frusto-pie-shaped wedges to increase the effective angles of the ends of appropriate fixtures. In all cases the parts providing the angles and thus determining the arch radius will be color coded to simplify selection and to limit errors.

In all embodiments described thus far the fixtures have been symmetrical in plan view about a plane perpendicular to the top and bottom of the fixture and bisecting the component lengthwise. In another embodiment of the structure, having flat walls and peaked roof, all the fixtures are effectively rectangular in plan form except those at the juncture portions of the wall portions and roof portions and of the roof portions at the peak. Also, thus far, all the components have had essentially equal width fixtures. However, in all embodiments there may be components wide enough to incorporate windows or other openings.

The fixtures at the ends of the components at the ends of an assembly of components incorporate means for applying tension to the cables threaded through the fixtures to make the cable accessible to tensioning apparatus. Pulleys or the like may be used in the fixtures of the end components in an assembly. Means are also incorporated in these fixtures for attaching the cables at their ends and for locking the cables in position at their ends once adequate tension has been applied.

A preferred method of erection of the structure comprises the steps of (1) laying the assembly of components on the surface over which the structure is to be erected with the component that incorporates the tensioning means at one edge of the surface; (2) applying tension to the cables threaded through the fixtures and to auxiliary cables arranged to pull the ends of the assembly toward each other (The tension in the cables causes the assembly to fold into its intended final configuration); (3) locking the cables installed in the fixtures to maintain the applied tension and (4) removing the auxilliary cables. In more confined areas the assembly is laid on the surface with its center line over the center line of the surface and the components at the ends of the assembly folded or rolled up to allow the complete assembly to fit within the confines of the surface to be covered by the structure. Then, using pneumatic bags, a crane or fork lifts, the center portion of the assembly is lifted until the ends of the assembly are unfolded or unrolled and the end components are in position at the edges of the surface. The cables in the fixtures are then tensioned and locked and the lifting equipment removed.

The components may be as long as the intended length of the structure or the structure may comprise a plurality of arches placed end to end to provide the intended length of the overall structure.

If the complete structure is intended to be closed at one or both ends, the ends will be made using any of various techniques known in the art. Similarly, the components of the arches may be made using any of various materials and techniques known in the art, materials including concrete, metal, plastic, fibre reinforced plastic, wood or combinations.

BRIEF DESCRIPTION OF THE DRAWINGS

FIG. 6 illustrates a structure having two extra width components in which windows or the like may be installed.

FIG. 7 illustrates a fixture at the end of a component, the fixture incorporating means to adjust the angles of its ends relative to its top and bottom.

FIG. 8 is a cutaway view of a fixture incorporating a pulley to facilitate tensioning the cables in the structure and means for locking the cables in place.

DETAILED DESCRIPTION OF THE INVENTION

The invention is structure comprising a plurality of essentially identical components which are pivotally interconnected and pivoted into full contact with each other and held in contact by tension force applied by cables entirely enclosed within the components.

Figure 1:
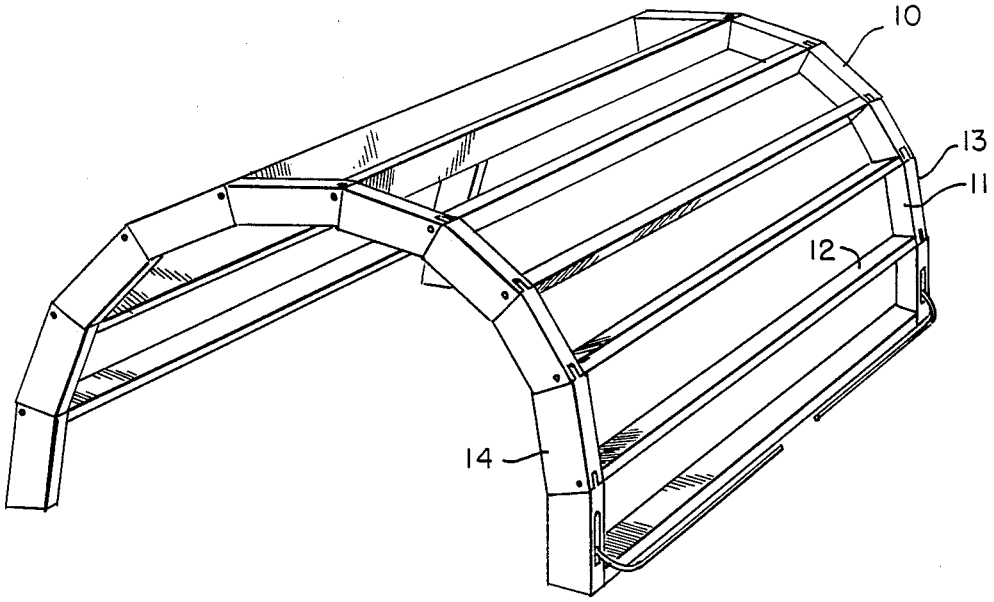
FIG. 1 is a perspective view of a small arch structure incorporating all the basic features of the invention.
Figure 2:
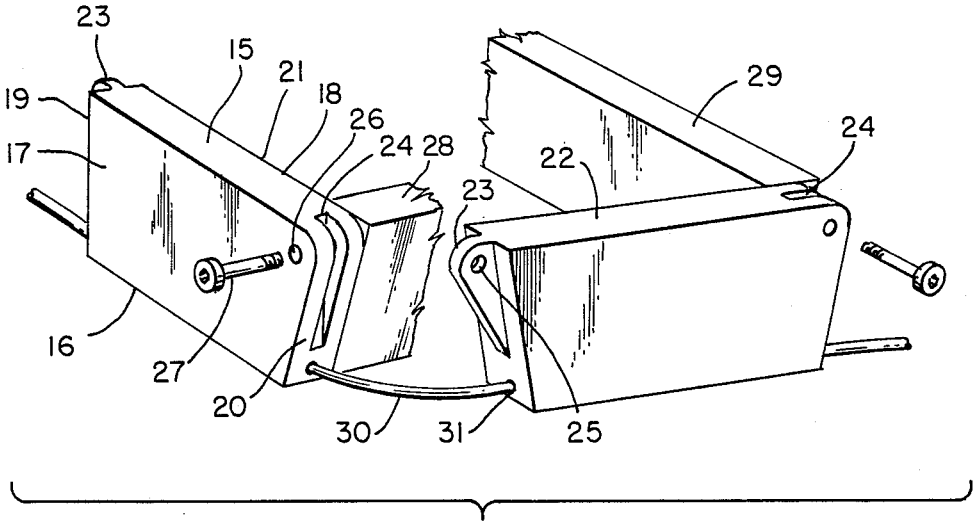
FIG. 2 illustrates two fixtures, showing details of their pivoted interconnections.

FIG. 1 illustrates structure 10 which is a basic embodiment of the invention. The structure comprises a plurality of components of which component 11 is typical. Each component comprises a beam 12 having a longitudinal axis, the beam having a fixture attached at each of its ends, fixtures 13 and 14 being typical. The fixtures may be made as integral parts of the component or be made separately and attached by any suitable means known in the art. In a preferred embodiment the fixtures, as seen in FIG. 2, are boxlike, having a top 15, a bottom 16, faces 17 and 18 and ends 19 and 20. In preferred embodiments the height of the fixtures, top to bottom is in the range of 2 to 4 times the thickness, from face to face, and the length, from end to end, is in the range of 2 to 4 times the height. The faces are parallel to each other and the tops and bottoms are parallel to each other. There are exceptions to these proportions for special purposes, some of which are described below. The beams adjoin the fixtures of each component near or at the ends of the fixtures, with the fixtures extending in the same direction from the beams.

In FIG. 2, fixtures 21 and 22 are illustrated to show preferred details of their embodiment. The tops, bottoms, ends and faces are numbered as in FIG. 1. Each fixture has a flange 23 at one of its ends, normal to the end, and a slot 24 in the other. Pinholes 25 in the flanges line up with pinholes 26 in the fixtures when the flanges are inserted into the slots and pin(s) 27 are inserted through the holes to pivotally connect the fixtures. The pins are threaded into beams 28 and 29 to hold them in place. Cable 30 is threaded through holes 31. The beams are shown schematically since a wide variety of types of beams are suitable to this use. In this embodiment only one beam is used per component, each component comprising a beam and attached fixtures. Two or more beams may be used per component if desired.

The structure in FIG. 1 incorporates arches having a single constant radius. In such a structure the faces of the fixtures have a frusto-equilateral triangle shape with the base of the triangle at the tops of the fixtures.

Figure 3:
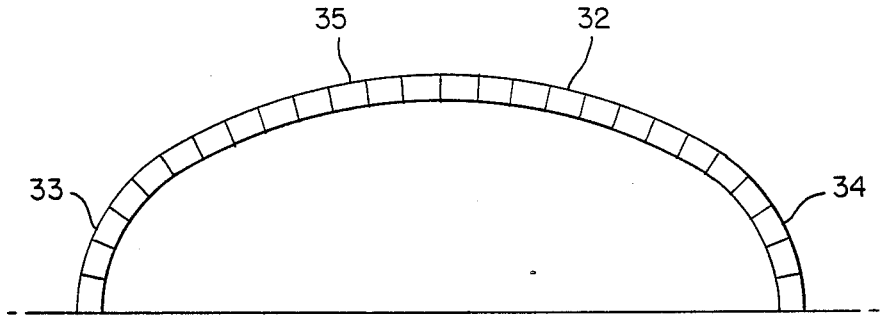
FIG. 3 illustrates an end view of a structure having equal radius end portions and a larger radius center portion.

FIG. 3 is an end view of a structure 32 incorporating arches having end portions 33 and 34 of equal radii and center portion 35 having a radius larger than that of the end portions. This arrangement produces a semi-pseudo-elliptical arch shape which allows sheltering a given area with less structural material than needed with a single radius arch and with less volume to heat or cool if that is necessary.

Figure 4:
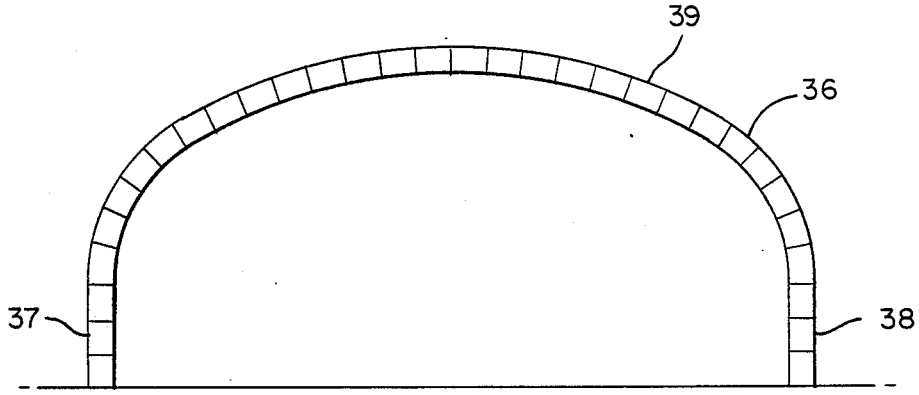
FIG. 4 illustrates an end view of a structure having flat, vertical end portions and a semi-pseudo-elliptical portion between the end portions.

The structure 36 in FIG. 4 has flat vertical end portions 37 and 38, made with rectangular plan form fixtures and a semi-pseudoelliptical portion 39 between the end portions. In smaller structures the flat vertical end portions provide better utilization of the sheltered area and volume.

Figure 5:
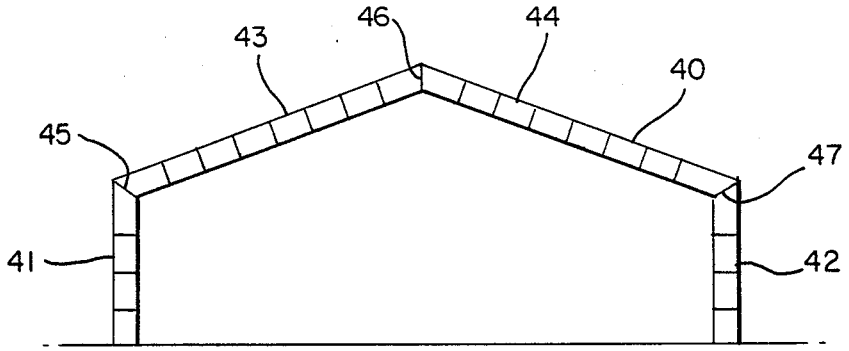
FIG. 5 illustrates an end view of structure having flat side portions and a peaked roof with two flat portions.

The structure 40 in FIG. 5, shown in end view, has flat vertical sides 41 and 42 and a peaked roof comprising portions 43 and 44. In this structure all the fixtures are rectangular in plan view except those at the juncture portions 45, 46 and 47. The fixtures at the junctures are shaped as shown to suit their purposes, the shapes at the juncture portion being trapezoidal with the tops and bottoms parallel.

The structure 48, shown in end view in FIG. 6, has a constant radius arch but incorporates two extra wide components 50 and 51. These components are wide enough to incorporate windows and the like.

FIG. 7 illustrates an alternate embodiment of the fixtures used at the ends of the components. Fixture 52 has angled ends 53 and 54. Angles A and A' are the smallest considered to be useful. With this embodiment all the fixtures would be basically identical regardless of the structure shape in which they are used. Changes in structural configuration requiring greater angles at the ends of the fixtures are provided for by frusto-pie shaped inserts attachable to the ends of the fixtures to provide the desired angle of the end to the top surface of the fixture. Insert 55 is a typical insert held in place by adhesive. Slot 56 in the insert allows ample clearance for the tensioning cable. Each insert is designed to provide the required angular compensation for the fixtures it is used between; thus, fewer inserts are needed than if inserts were added to each end of each fixture. The use of components all having the same end fixtures, along with inserts, may be less expensive overall than providing a variety of shapes of fixtures. In any case, the parts are color coded to indicate the radius of the arch they will produce when used.

FIG. 8 is a cutaway illustration of fixtures to be used at the ends of each assembly of components at the ends of an assembly. Pulley 57 fits in slot 58 in fixture 59 attached to beam 60. The pulley is supported on shaft 61. The tension cable 62 is threaded through hole 63 into slot 58 around the pulley and out slot end 64.

Toothed cam 65 is pivoted on pin 66 and engages the cable under the force of gravity. It allows the cable to move freely in the direction D to allow tensioning the cable and prevents motion of the cable in the direction opposite to direction D, thus serving to maintain tension forces developed in the cable. To unlock the cam and release the tension in the cable in the process of dismantling the structure a rod is inserted in hole 67 in the cam and used to rotate the cam in the direction indicated by arrow R to disengage the cam from the cable. The release may be facilitated by increasing the tension in the cable slightly as the cam is rotated by the rod. This mechanism may be used at both ends of the assemblies so that tensioning the cable may be done from either end or both ends. The surface contact ends of these fixtures are not fitted with flanges. In FIG. 8 the beam 60 to which the fixture is attached is at the grooved end of the fixture. It may be attached at the other end of the fixture.

It is considered to be understandable from this description that the invention meets its objective. Structures are provided which are readily erected or dismantled and comprise essentially identical components. The structure is clean, being free of exposed braces, cables, struts and the like. The structures are generally arched and arch radii in a range from a minimum to infinity (flat structure) are possible with one or more than one radius in each arch.

It will also be understood that while particular embodiments of the invention are described in this disclosure, other embodiments are possible within the scope of the invention which is limited only by the attached claims.

I claim:

1. An erectable/dismantleable structure comprising at least one assembly, said assembly having first and second ends and comprising:

a plurality of components two cables having first and second cable ends, means for securing said first and second cable ends at said first and second assembly ends, each of said components comprising:

at least one beam having first and second beam ends, and two fixtures, one attached to said at least one beam at said first beam end, the other attached to said at least one beam at said second beam end, each of said fixtures having a boxlike shape, a top, a bottom, a first fixture end, a second fixture end and first and second faces, said top and bottom being parallel to each other, said first and second faces being parallel to each other, said faces being frusto-triangular in shape, said shape having a base, said base being at said top, each of said fixtures having a cable hole extending from said first fixture end to said second fixture end and near said bottom, means for pivotal attachment of said plurality of components by pivotal connections near said tops and said first and second ends of said fixtures, whereby said assembly is formed by pivotal attachment of said plurality of said components by said means for pivotal attachment, said two cables being threaded through said cable holes, one through said fixtures at said first ends of said beams, the other through said fixtures at said second ends of said beams, said first cable ends being secured at said first end of said assembly, by said means for securing, whereby tension applied to said two cables pivots said ends of said fixtures on said components about said means for pivotal attachment into contact with adjacent fixtures and, by virtue of the frusto-triangular shapes of said faces of said fixtures, said assembly assumes an arch shape and is maintained in said shape by securing said second ends of said two cables to said second end of said assembly by said means for securing said cable ends.

2. An erectable/dismantleable structure comprising at least one assembly, said assembly having first and second ends and comprising:

a plurality of components pivotally interconnected, two cables having first and second cable ends, means for securing said first and second cable ends at said first and second assembly ends, and each of said components comprising:

at least one beam having first and second beam ends, and two fixtures, one attached to said at least one beam at said first beam end, the other attached to said at least one beam at said second beam end, each of said fixtures having a boxlike shape, a top, a bottom, a first fixture end, a second fixture end and first and second faces, said top and bottom being parallel to each other, said first and second faces being parallel to each other, said faces being frusto-triangular in shape, said shape having a base, said base being at said top, each of said fixtures having a cable hole extending from said first fixture end to said second fixture end near said bottom, each of said fixtures having a flange extending normal to said first fixture end and a groove in said fixture end, said fixtures being attached to said at least one beam such that their said tops are parallel and said first fixture ends extend to the same direction from said at least one beam, each of said flanges having a first pinhole near said top and perpendicular to said face, each of said fixtures having a second hole extending through it from said first face to said second face, through said groove in said second fixture end and near said top, whereby said assembly is formed by pivotal attachment of said plurality of components to each other by insertion of said flanges of one component into said grooves in an adjacent component and inserting two of said plurality of pins through said first and second pinholes in the fixtures at said first and second beam ends of adjacent components, said two cables being threaded through said cable holes, one through said fixtures at said first ends of said beams, the other through said fixtures at said second ends of said beams, said first cable ends being secured at said first end of said assembly, by said means for securing, whereby tension applied to said two cables pivots said ends of said fixtures on said components about said plurality of pins into contact with adjacent fixtures and, by virtue of the frusto-triangular shapes of said faces of said fixtures, said assembly assumes an arch shape, said second cables ends being secured at said second end of said assembly by said means for securing said cable ends, whereby said assembly is maintained in said arch shape.

3. The structure of claim 1 in which said faces are frusto-equilateral triangular in shape.

4. The structure of claim 2 in which said faces are frusto-equilateral triangular in shape.

5. The structure of claim 1 having, when erected, flat portions joined at juncture portions, said flat portions comprising flat portion components, said fixtures of said flat portion components having rectangular shape faces, said fixtures of said juncture portions components having trapezoidal shapes with said tops and bottoms parallel.

* * * * *